US009347257B2

(12) United States Patent
Letonje et al.

(10) Patent No.: US 9,347,257 B2
(45) Date of Patent: May 24, 2016

(54) LIFTING DOOR HAVING A MOVABLE DOOR LEAF GUIDE

(75) Inventors: Jure Letonje, Mengeš (SI); Janez Küzmič, Litija (SI); Andrej Mazej, Vodice (SI)

(73) Assignee: EFAFLEX INŽENIRING d.o.o. Ljubljana, Ljubljana (SI)

( * ) Notice: Subject to any disclaimer, the term of this patent is extended or adjusted under 35 U.S.C. 154(b) by 37 days.

(21) Appl. No.: 14/235,946

(22) PCT Filed: Jul. 19, 2012

(86) PCT No.: PCT/EP2012/003043

§ 371 (c)(1),
(2), (4) Date: May 13, 2014

(87) PCT Pub. No.: WO2013/017209

PCT Pub. Date: Feb. 7, 2013

(65) Prior Publication Data

US 2014/0246157 A1 Sep. 4, 2014

(30) Foreign Application Priority Data

Jul. 29, 2011 (DE) ..... 10 2011 052 304

(51) Int. Cl.
*E06B 9/92* (2006.01)
*E06B 9/15* (2006.01)
(Continued)

(52) U.S. Cl.
CPC ..... *E06B 9/15* (2013.01); *E05D 15/165* (2013.01); *E05D 15/24* (2013.01); *E05F 15/20* (2013.01);
(Continued)

(58) Field of Classification Search
CPC ..... E06B 2009/588; E06B 2009/587; E06B 9/92; E05D 15/244; E05D 15/246; E05D 15/248
USPC ..... 160/209, 242, 201, 133, 41
See application file for complete search history.

(56) References Cited

U.S. PATENT DOCUMENTS 423,739 A 3/1890 Cook
822,130 A 5/1906 Hussey
(Continued)

FOREIGN PATENT DOCUMENTS

CA 2436381 A1 1/2005
CN 101939502 A 1/2011
(Continued)

OTHER PUBLICATIONS

International Search Report, International Patent Application No. PCT/EP2012/003043, date of actual completion of the international search Dec. 20, 2012, 2 pages.
(Continued)

*Primary Examiner* — David Purol
(74) *Attorney, Agent, or Firm* — Fitch, Even, Tabin & Flannery, LLP

(57) ABSTRACT

The invention relates to a lifting door, comprising a movable door leaf made of slats, the slats being connected to one another so as to bend, and comprising structure-mounted frames. Lateral guides for the door leaf having a vertical section and a lintel section, and frame sealing elements of a sealing assembly are arranged thereon, which close a gap between the door leaf and a section of the frames facing the door opening when the lifting door is closed. The lintel sections of the guides, together with the vertical sections of the guides, are displaceably mounted on the frames, wherein the guides can only be displaced in a direction that is diagonal to the door leaf plane, but not in a moving direction of the door leaf. Thus, an improved lifting door having greater operational safety, and at the same time an improved sealing effect between the door leaf and the door opening can be achieved.

8 Claims, 9 Drawing Sheets

(51) Int. Cl.

| | |
|---|---|
| ***E06B 9/06*** | (2006.01) |
| ***E06B 9/58*** | (2006.01) |
| ***E05D 15/16*** | (2006.01) |
| ***E05D 15/24*** | (2006.01) |
| ***E05F 15/20*** | (2006.01) |
| ***E06B 9/68*** | (2006.01) |
| ***E05F 15/70*** | (2015.01) |
| *E05F 15/668* | (2015.01) |

(52) U.S. Cl.

CPC ..... *E05F 15/70* (2015.01); *E06B 9/0646* (2013.01); *E06B 9/58* (2013.01); *E06B 9/68* (2013.01); *E05F 15/668* (2015.01); *E05Y 2201/47* (2013.01); *E05Y 2201/638* (2013.01); *E05Y 2201/684* (2013.01); *E05Y 2600/13* (2013.01); *E05Y 2800/12* (2013.01); *E05Y 2900/00* (2013.01); *E05Y 2900/106* (2013.01); *E05Y 2900/132* (2013.01); *E06B 2009/0684* (2013.01); *E06B 2009/587* (2013.01); *E06B 2009/588* (2013.01)

(56) References Cited

U.S. PATENT DOCUMENTS

| | | | | |
|---|---|---|---|---|
| 1,869,347 | A | | 7/1932 | Johnson |
| 2,069,665 | A | | 2/1937 | Bouthillier |
| 2,166,746 | A | | 7/1939 | Bartel |
| 2,738,179 | A | * | 3/1956 | Joy ..... 454/169 |
| 2,749,582 | A | | 6/1956 | Beck |
| 2,820,516 | A | | 1/1958 | Cookson, Jr. et al. |
| 2,827,114 | A | | 3/1958 | Stroup |
| 2,855,989 | A | | 10/1958 | Pritchard |
| 3,027,937 | A | | 4/1962 | Wilson |
| 3,034,575 | A | | 5/1962 | Stroup |
| 3,331,158 | A | | 7/1967 | Frakes |
| 3,373,527 | A | * | 3/1968 | Olsson ..... 49/212 |
| 3,947,998 | A | | 4/1976 | Matsubara |
| 4,119,133 | A | | 10/1978 | Wolf |
| 4,250,941 | A | | 2/1981 | McNally |
| 4,320,793 | A | | 3/1982 | Lindbergh |
| 4,601,320 | A | * | 7/1986 | Taylor ..... 160/271 |
| 4,880,046 | A | | 11/1989 | Gesy |
| 5,277,240 | A | | 1/1994 | Epema et al. |
| 5,394,924 | A | | 3/1995 | Rejc |
| 5,402,841 | A | | 4/1995 | Tierney |
| 5,484,007 | A | | 1/1996 | Rejc |
| 5,488,982 | A | | 2/1996 | Rejc |
| 5,819,831 | A | * | 10/1998 | Schanz ..... 160/133 |
| 6,123,139 | A | | 9/2000 | Kalempa et al. |
| 2011/0030278 | A1 | | 2/2011 | Breznikar et al. |
| 2012/0312483 | A1 | | 12/2012 | Letonje et al. |

FOREIGN PATENT DOCUMENTS

| | | | |
|---|---|---|---|
| DE | 4015214 | A1 | 11/1991 |
| DE | 19715295 | A1 | 10/1997 |
| DE | 19915376 | A1 | 10/2000 |
| DE | 20206188 | U1 | 8/2003 |
| DE | 10324084 | A1 | 12/2003 |
| DE | 202004000679 | U1 | 4/2004 |
| DE | 10300302 | A1 | 7/2004 |
| DE | 102008007592 | A1 | 8/2009 |
| EP | 0769605 | A2 | 4/1997 |
| JP | 2000170461 | A | 6/2000 |
| JP | 2002097864 | A | 4/2002 |
| JP | 2002-541364 | A | 12/2002 |
| JP | 2003253976 | A | 9/2003 |
| JP | 2003-343172 | A | 12/2003 |
| JP | 2004-162427 | | 6/2004 |
| JP | 2009-511792 | A | 3/2009 |
| WO | 2000060208 | A1 | 10/2000 |
| WO | 2007045423 | A1 | 4/2007 |

OTHER PUBLICATIONS

International Search Report, International Patent Application No. PCT/EP2011/000202, date of actual completion of the international search Feb. 25, 2011, 2 pages.

English Translation of International Preliminary Report on Patentability and Written Opinion, International Patent Application No. PCT/EP2011/000202, date of issuance Aug. 28, 2012, 12 pages.

* cited by examiner

LIFTING DOOR HAVING A MOVABLE DOOR LEAF GUIDE

CROSS REFERENCE TO RELATED APPLICATIONS

This application is a national phase application of International Application No. PCT/EP2012/003043, filed Jul. 19, 2012, designating the United States and claiming priority to German Patent Application No. 10 2011 052 304.9, filed Jul. 29, 2011, both of which are incorporated by reference as if fully rewritten herein.

FIELD

The invention relates to a lifting door comprising a movable door leaf and structure-mounted frames arranged at both sides of a door opening, wherein lateral guides for the door leaf which face each other are arranged at the frames, said lateral guides each comprising a vertical section and a lintel section, wherein the door leaf is made of slats being connected to one another so as to bend and covers the door opening in the closed condition, wherein the door leaf is guided in the lateral guides such that it is accommodated in the lintel sections when the lifting door is open and in the vertical sections of the guides when the lifting door is closed, wherein the vertical sections of the guides are displaceably mounted on the frames, so that the door leaf is displaceable in a direction to the outer side of the door when the lifting door is closed, and wherein the lifting door comprises a trigger device responding to a movement of the door leaf and, based thereon, causing the displacement of the vertical sections on the frames.

BACKGROUND

A lifting door designed as a fast-running industrial door has, for instance, become known from DE 199 15 376 A1. The door leaf is here designed in the kind of a slatted curtain, wherein the individual slats are connected to one another so as to bend against each other and are guided in lateral guides. The guides each comprise a vertical section and a spiral section, wherein the latter is arranged in the lintel region of the lifting door. The door leaf is guided in the lateral guides by means of guide rollers, wherein their rotational axes coincide with the pivot axes of the individual slats. At the side of the guide rollers which faces away from the door leaf, a collar is further arranged by means of which an indirect positive-locking accommodation of the side edges of the door leaf in the lateral guides exists. This known roller door is characterized by very high movement speeds of up to 4 m/s during opening and closing and by a low-noise and low-energy operation. Moreover, an adequate closure of the door opening is provided thereby.

The sealing of the movement gap between the door leaf and the door opening is effected with the roller door according to DE 199 15 376 A1 by means of lip seals. They are attached to the frames and rest on the two large faces of the door leaf, so that they close the respectively existing movement gap. Although this sealing system has absolutely stood the test in practice, it is deemed to be improvable. In particular, these lip seals are subject to considerable wear since the door leaf slides along them at high movement speed during opening and closing, which results in abrasion especially on the sealing elements. This applies in analogy also to other sealing systems in which, for instance, brush sealing systems are used instead of the lip seals. These sealing elements therefore have to be exchanged at predetermined intervals.

Moreover, such roller doors, as they have been disclosed in DE 199 15 376 A1, are also used for special purposes, for instance, as freezer doors, clean room doors, fire protection doors, as door closures in pharmaceutical companies, or the like. Due to the specific case of use there exists a special need of a reliable and long-lasting sealing of the movement gap between the door leaf and the door opening, wherein this is of particular importance at the outer side of the door.

Furthermore, DE 103 00 302 A1 and U.S. Pat. No. 2,069,665 disclose lifting doors in which the lateral guides are divided such that the vertical section is adapted to be pivoted relative to the lintel section. In the open position of the lifting door the vertical section is inclined to the door opening plane such that it is farther spaced apart therefrom at the upper end of the door opening than at the lower end. In the course of the closure movement of the door leaf, the door leaf then acts on a frame-side actuator, so that the upper ends of the vertical sections are pivoted in the direction of the door opening. Thus, the door leaf then rests on the frames and/or the sealing elements that are possibly arranged there, and closes the gap between the door leaf and the door opening.

A similar construction of a lifting door has been known from U.S. Pat. No. 5,402,841. Here, the door leaf is guided in lateral guides comprising a vertical section and a flat-stretched lintel section which are firmly connected with each other. These guides are mounted to be pivoted about rotational axes at their feet, so that they are adapted to be swiveled as a whole towards the door opening or away from the door opening. In the open position of the lifting door the guides are arranged to be inclined to the door leaf plane such that the upper ends of the vertical sections are again spaced apart from the door lintel. On closing of the door the door leaf is moved in the vertical sections, whereupon the guides are then pivoted by manual action toward the door opening such that the door leaf is pressed against a sealing assembly arranged there. This produces an air-tight closure.

A disadvantage of such lifting door systems is, however, that the sealing elements, at any rate in the lower region of the door opening, are still subject to considerable wear due to the door leaf sliding there along. Although the sealing elements do not wear off along their entire lengths, they still abrade distinctly in the lower region, so that no reliable sealing effect can be achieved there. Moreover, during the period of use of the lifting door systems with divided guide sections, the risk increases that a matching aligned connection between the lintel section and the vertical section can no longer be established. Then, a regular operation is no longer possible.

U.S. Pat. No. 1,869,347 finally discloses a lifting door arrangement in which, in the course of the closing movement of the door leaf, the vertical section of the guides is displaced parallel to the lintel section in the direction of the door opening. The displacing movement is initiated in that the door leaf meets, with its lower end shield that serves as a kind of trigger device here, the lower end of the vertical sections on both sides and takes them along for some distance up to the complete closing position due to the inherent weight of the door leaf. In this process, the vertical sections are each moved via an inclined connecting member guide both vertically and horizontally away from the assigned lintel section of the guides against a spring bias. The door leaf then rests on the frames of the door opening and establishes a more or less tight closure there. No sealing elements are apparently provided here. In the course of the opening movement the load at the lower end of the vertical sections on both sides finally ceases, so that they move back to their initial positions due to the spring bias and are in alignment with the lintel sections, so that the door leaf can be moved therein.

A disadvantage of this lifting door is that the door leaf performs a dragging movement at the frame elements of the door opening in the last portion of the closing movement. This results in considerable wear of the door leaf over the entire height thereof. Since a manual operation is apparently intended with this known lifting door, this is deemed to be acceptable due to the low movement speed. Such a lifting door is, however, not suited for fast-running operations.

Moreover, the spring assembly used for returning the vertical section is subject to substantial wear since it has to lift the inherent weight of the vertical section of the two guides during each opening movement. A particular problem is that, when the spring force decreases, there is no longer ensured that an aligned connection to the lintel section is reliably achieved. The door leaf can then no longer be moved into the lintel section without disruptions. The consequences of this are damages to the door leaf and problems during the operation of the lifting door.

It is therefore an object of the invention to further develop a generic lifting door such that it can be used with greater operational safety and at the same time improved sealing effect between the door leaf and the door opening.

SUMMARY

This object is solved by a lifting door with the features of claim 1. It is characterized in particular by the fact that the lifting door comprising a drive unit for the operation of the door leaf, that the lifting door comprises a sealing assembly with frame sealing elements that are arranged at the frames, wherein, when the lifting door is closed, they close a gap between the door leaf and a section of the frames which faces the door opening, wherein, when the lifting door is closed, the door leaf is pressed against the sealing assembly, that the lintel sections of the guides are of spiral shape, wherein the door leaf, in the open condition of the lifting door, is arranged therein with touch-free winding layers, that the lintel sections of the guides, together with the vertical sections of the guides, are displaceably mounted on the frames, and that the guides can only be displaced in a direction that is diagonal to the door leaf plane, but not in a moving direction of the door leaf.

In the scope of the invention there was found that the sealing effect can already be improved by modifying the cooperation of the door leaf with the sealing assembly in a particular manner. For this purpose, the invention for the first time provides to design the guides to move at the door arrangement only diagonally to the door leaf plane, i.e. to use a purely linear horizontal displacement.

In the scope of the invention there was further found that the door leaf, due to the accommodation in the vertical sections of the guides, behaves like a rigid plate and hence an efficient transfer of force is possible diagonally to the door leaf plane. Accordingly, in accordance to the invention it is possible, despite the door leaf construction of slats that are adapted to bend toward each other, to press the door leaf like a rigid element against the sealing assembly in a direction to the outer side of the door.

Thus, an extremely reliable sealing effect can be achieved since the sealing assembly may enfold its efficiency in a particularly good manner due to the pressure exerted. This way it is achieved that the door leaf rests on the sealing assembly in a more exact and a more reliable manner than this is the case in prior art.

In the case of the lifting door according to the invention, the sealing assembly is impacted diagonally to its longitudinal side and not, as in prior art, by a movement sliding there along. It is thus subject to less wear and attains accordingly a longer lifetime than the one in prior art. Thus, a particularly well sealed lifting door that is particularly long-living and reliable even with respect to the sealing assembly can be achieved.

It is hence possible to renounce a dragging sealing assembly, so that a particularly long lifetime thereof can be achieved. Furthermore, there results the advantage that the design freedom is particularly great with respect to the material of the sealing assembly since typically more suitable sealing materials and sealing shapes are available for pressed seals than for dragging seals.

Moreover, the lifting door according to the invention is characterized by particularly high operational safety. In contrast to the closest prior art U.S. Pat. No. 1,869,347 as well as to the tilt solutions according to DE 103 00 302 A1 and U.S. Pat. No. 2,069,665, the aligned connection between the vertical section and the horizontal section of the respective guide is maintained in accordance with the invention. The door leaf of the lifting door according to the invention is thus movable relative to the frames basically in any position of the guides. The danger of damages of the door leaf due to a possibly non-aligned connection of the vertical section to the lintel section which exists in prior art is therefore eliminated in accordance with the invention. The operational reliability of the lifting door according to the invention is thus, in contrast to prior art, independent of possible spring assemblies or the like for resetting a displacement between a vertical section and a lintel section of the guide.

Thus, the lifting door according to the invention is also particularly suited for specific applications, e.g. as a freezer door, in which, due to the environmental conditions, the aligned orientation of lintel section and vertical section might be delayed in operation. This prior art disadvantage has now been overcome and the construction of the lifting door in accordance with the invention may be simpler.

It is of additional advantage that the lifting door comprises a trigger device responding to a movement of the door leaf and, based thereon, causing the displacement of the vertical sections at the frames. This process may be automated with little technological effort, and it is additionally ensured that that this displacement only takes place when the door leaf has completely entered the vertical sections. Thus, a very reliable lifting door arrangement can be achieved with particularly simple constructional effort.

Since the relative movement of the two guides relative to the frames takes place horizontally only, there results additionally a very low susceptance to failure of the lifting door according to the invention.

Moreover, the lifting door according to the invention enables, due to its permanent guiding in the lateral guides and due to the touch-free winding of the door leaf in the spiral lintel section, a reliable fast-running operation such as it is, as a rule, desired for industrial applications.

It is of additional advantage that the lifting door according to the invention may be of particular compact structure. In particular during the transition from the vertical section of the guide to the lintel section no particular concessions in constructional regard are necessary in contrast to prior art. While prior art provided appropriate buffer guide lengths in the guide sections to give the arrangement sufficient time for the guide sections to return to an aligned constellation, a cutting line does, in accordance with the invention, not exist here, so that the lintel section touches directly on the vertical section. In this respect it is, in accordance with the invention, substantially also irrelevant in which position the last, uppermost guide roller of the door leaf is when the lifting door is closed, that means whether it is still positioned at the exit of the lintel section or already within the vertical section, as long as a sufficient sealing effect is achieved at the door opening.

DE 103 24 084 A1 indeed discloses a roller door with a slatted curtain in which a winding shaft arranged in the door lintel is also adapted to be shifted linearly in a direction diagonal to the door leaf plane. This construction is, however, a lifting door with winding layers of the slatted curtain which are positioned on top of each other and touch each other on the winding shaft, and not a spiral guide for touch-free winding of the door leaf. The door leaf is accordingly also coupled directly to the winding shaft at the upper end. Through the latter, the driving force is accordingly also introduced to the door leaf at the upper end. It is an object of this known arrangement to enable, despite the fact that the diameter of the winding shaft changes continuously during the winding process with the slatted curtain already wound, a substantially tangential intake of the roller door curtain from the lateral guide rails and/or into same. Due to this known distance displacement assembly the distance of the rotational axis of the winding shaft from the lintel of the door openings to be closed is thus variable as a function of the diameter of the slatted curtain winding.

However, a displacement of the guides for the door leaf is not achieved with this construction known from DE 103 24 084 A1. They are rather structure-mounted on the frames, so that, like with the rest of prior art, the conventional sealing problem exists here. A guide of the door leaf in the lintel region is neither provided nor necessary with this known roller door construction since the door leaf is wound directly on the winding shaft. This known construction is thus based on completely different basic prerequisites than the present invention.

Advantageous further developments of the lifting door according to the invention are the subject matter of the dependent claims 2 to 7.

Thus, the lintel sections of the guides may each be arranged on a carrier element, wherein the carrier elements with the lintel sections of the guides arranged thereon, together with the vertical sections of the guides, are displaceably mounted on the frames. Then, a particularly reliable guiding of the spiral lintel sections is possible, so that the operational safety of the lifting door according to the invention is further improved. In particular, a possible canting of the guides during displacement may be avoided in an even more reliable manner.

It is further possible that the trigger device is a door leaf accommodation arranged in the region of an end element of the door leaf and introduces the driving force of the drive unit on the door leaf Thus, the invention can be implemented with particularly little constructional effort since such a door leaf accommodation is mostly available anyway with conventional lifting doors. It is in particular possible without, or at best a very small, constructional adaptation of the door leaf accommodation, to use it as a trigger device. Furthermore, the driving force of the drive unit is thus used in a particularly efficient manner for initiating the displacing movement of the vertical sections at the frames.

In accordance with an embodiment variant, the trigger device may cooperate with a frame-side actuator initiating the displacement of the guides via displacement mechanisms, wherein at least two, preferably at least three, and in particular more than four displacement mechanisms are provided at each side of the door. Thus, the simultaneous introduction of a force for displacing the vertical sections and the lintel sections of the guides to the outer side of the door is enabled in several places across the height of the door leaf Canting of the guides may thus be prevented reliably since their movement takes place in terms of a horizontal parallel displacement simultaneously across the entire longitudinal side of the guides in the region of the door opening. Accordingly, at least two displacement mechanisms are arranged at each side of the door which each engage at least in the upper and lower regions of the vertical sections of the guides. Depending on the door height it may, however, also be expedient to provide three, four or more displacement mechanisms at each side of the door so as to achieve a regular pressing of the door leaf that is accommodated in the vertical sections of the guides and that is moved simultaneously therewith, against the sealing assembly. Exactly in the case of door heights of more than five meters it is usually expedient to use more than four displacement mechanisms at each side of the door. In this respect, the actuator is preferably designed as an actuator rod cooperating with the displacement mechanisms and enabling simultaneous actuation thereof. Thus, a reliable mode of actuation is achieved with simple technological means.

Alternatively it is also possible that the trigger device comprises actuator accommodations fastened on both sides at the upper and lower ends of the door leaf, into which guide rollers mounted on the frame side engage to produce the displacement of the guides at the frames in the course of the closing process of the door leaf. This embodiment variant is characterized by a particularly low constructional effort since an actuator rod in each frame, etc. may be renounced. Typically, however, only an introduction of force at the upper and lower ends of the door leaf will be provided then. In this connection, the guides are displaced indirectly via the displacing movement of the door leaf in a direction to the outer side of the door of the sealing assembly. Exactly in the case of lifting doors with door leaves of comparatively low height does this alternative design of a trigger device, however, constitute a cost-efficient and feasible variant.

In a further alternative it is possible that the trigger device is a control unit controlling a separate drive means by which the displacement of the guides at the frames can be established after termination of the closing movement of the door leaf. This embodiment variant requires the least constructional modification effort at the door leaf and/or door leaf drive as compared to conventional constructions and can moreover be implemented with respect to control technology in a very reliable manner and with simple means. The separate drive means comprises in the region of each frame at least two, preferably at least three, and in particular more than four control elements establishing the displacement of the guides at the frames. The number of control elements is, also in this embodiment variant, to be chosen as a rule on the basis of the predetermined door height of the lifting door according to the invention, wherein a larger door height should generally involve a larger amount of control elements.

Moreover, the sealing assembly may further comprise a lintel sealing element arranged in the door lintel region and closing a movement gap existing there between the door lintel and the door leaf in the case of a displaced door leaf. Thus, the sealing effect at the lifting door according to the invention can be improved even further. It is in particular also possible that the lintel sealing element is connected with the lateral frame sealing elements, so that a gap in the joint area of these sealing elements can be avoided. The lintel sealing element and the two frame sealing elements may be designed integrally, e.g. in the form of a tube seal, or else be welded and/or glued to one another at the ends abutting against each other.

In accordance with a further aspect of the present invention, according to claim 8 there is provided a frame for a lifting door according to the invention which comprises a guide for a door leaf with a vertical section and a lintel section, wherein the vertical section of the guide is displaceably mounted on the frame. This frame is characterized in that it comprises a frame sealing element of a sealing assembly which, when the lifting door is closed, closes a gap between the door leaf and a section of the frame which faces the door opening, that the lintel section of the guide is of spiral design and is, together with the vertical section of the guide, displaceably mounted on the frame, and that the guide can only be displaced in a direction that is diagonal to the door leaf plane, but not in a moving direction of the door leaf.

By means of this frame, the advantages explained above with respect to the lifting door according to the invention can be achieved in analogy. In addition, the frame constitutes a retrofitting and/or rebuilding part for conventional lifting doors, by means of which the latter can be improved in the manner according to the invention.

The frame according to the invention can be developed further by the corresponding detail features of the dependent claims 2 to 7, wherein the above-explained advantages are thus also enabled.

In accordance with another aspect of the present invention there is provided, according to claim 10, a method for closing a gap at a lifting door, which can be used in a particularly advantageous manner with the lifting door in accordance with the invention. This method is characterized by the following steps: Moving the door leaf into the closing position, and displacing the lintel sections of the guides together with the vertical sections of the guides in a direction diagonal to the door leaf plane in the course of the closing movement or subsequent thereto in a direction to the outer side of the door, without a movement of the guides in the moving direction of the door leaf, so that the door leaf is pressed against the sealing assembly.

This method according to the invention enables in an advantageous manner to establish an improved sealing effect between the door leaf and the door opening, wherein additionally very little wear occurs at the sealing assembly. In addition, in contrast to prior art, in operation there occurs no displacement between the vertical section and the lintel section of the guides, so that the lifting door according to the invention can be used in a particularly operation-safe manner. The method according to the invention therefore leads to a particularly long and reliable use of a lifting door according to the invention even with high movement speeds of e.g. 3 m/s.

BRIEF DESCRIPTION OF THE DRAWINGS

The lifting door according to the invention will be explained in more detail in the following in embodiments by means of the Figures of the drawing. There show.

DETAILED DESCRIPTION

Figure 1:
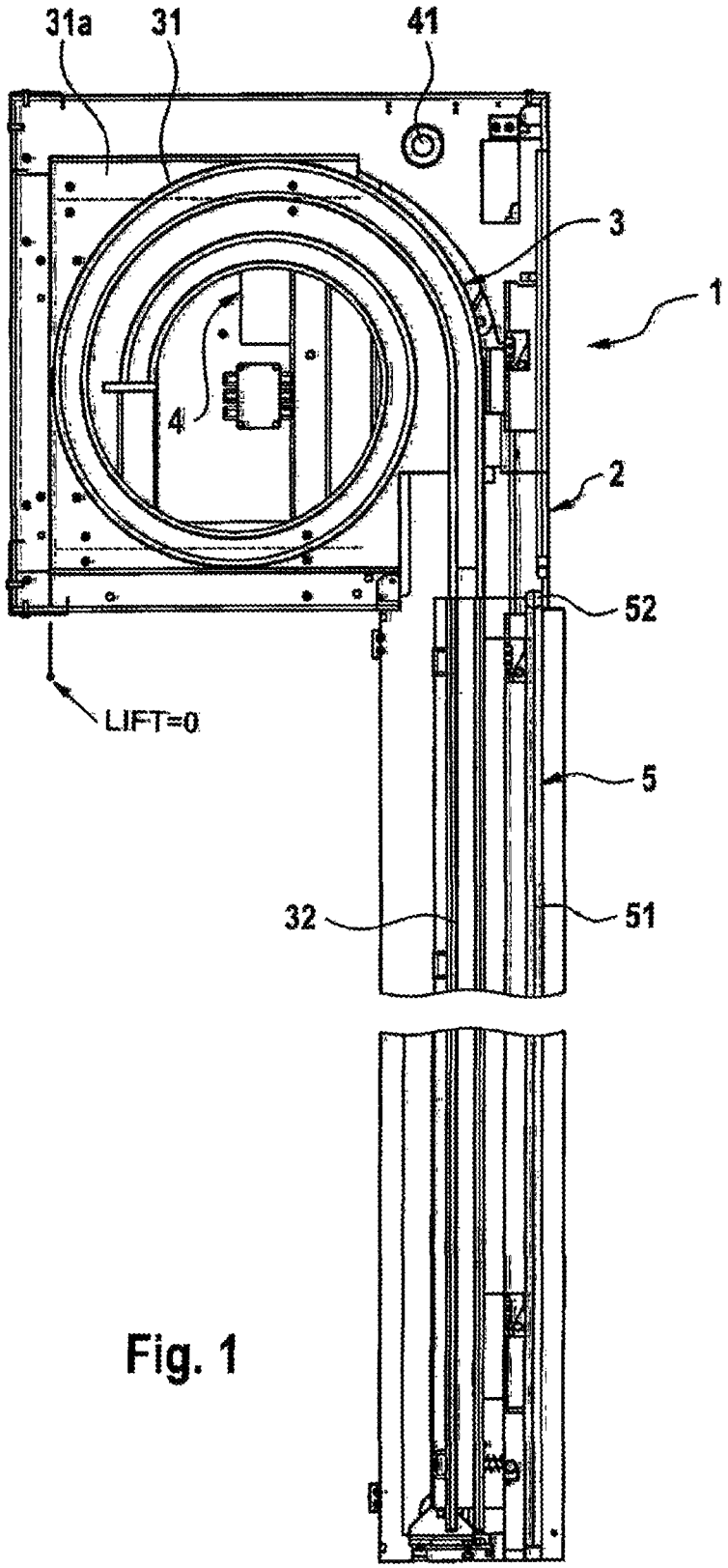
FIG. 1 a side view on the region of a frame of a lifting door according to the invention, wherein the door leaf has been omitted for clarification and the guide is in its basic position for operation of the door leaf.

In accordance with the illustration in FIG. 1, a lifting door 1 comprises a frame 2 comprising a guide 3 for a door leaf that is not illustrated in this Figure. FIG. 1 illustrates the view of a frame 2 positioned at the left in exit direction through the door opening. In the following, this description will mostly only explain the region of one side of the door, but a correspondingly designed frame arrangement with guide, etc. is available in mirror image at the other side of the door opening. The lifting door 1 comprises further a drive unit 4 with a motor and a drive shaft 41 extending across the breadth of the door, and a sealing assembly 5. The drive unit 4 is arranged firmly, i.e. immovably, on the frame 2.

The guide 3 comprises a lintel section 31 that is, in the instant embodiment, designed as a spiral and attached to a carrier element 31*a*. Therein, the door leaf is accommodated in a touch-free winding in the door lintel region when the lifting door 1 is open. The guide 3 further comprises a vertical section 32 in which the door leaf is positioned when the lifting door 1 is closed. A guide of inverse design is arranged at the opposite frame of the door opening.

The guide 3 is mounted on the frame 2 to be displaced and moved horizontally thereto. FIG. 1 illustrates the condition in which the guide 3 is in the starting position in which the door leaf can be moved from one region to the other one.

Figure 2:
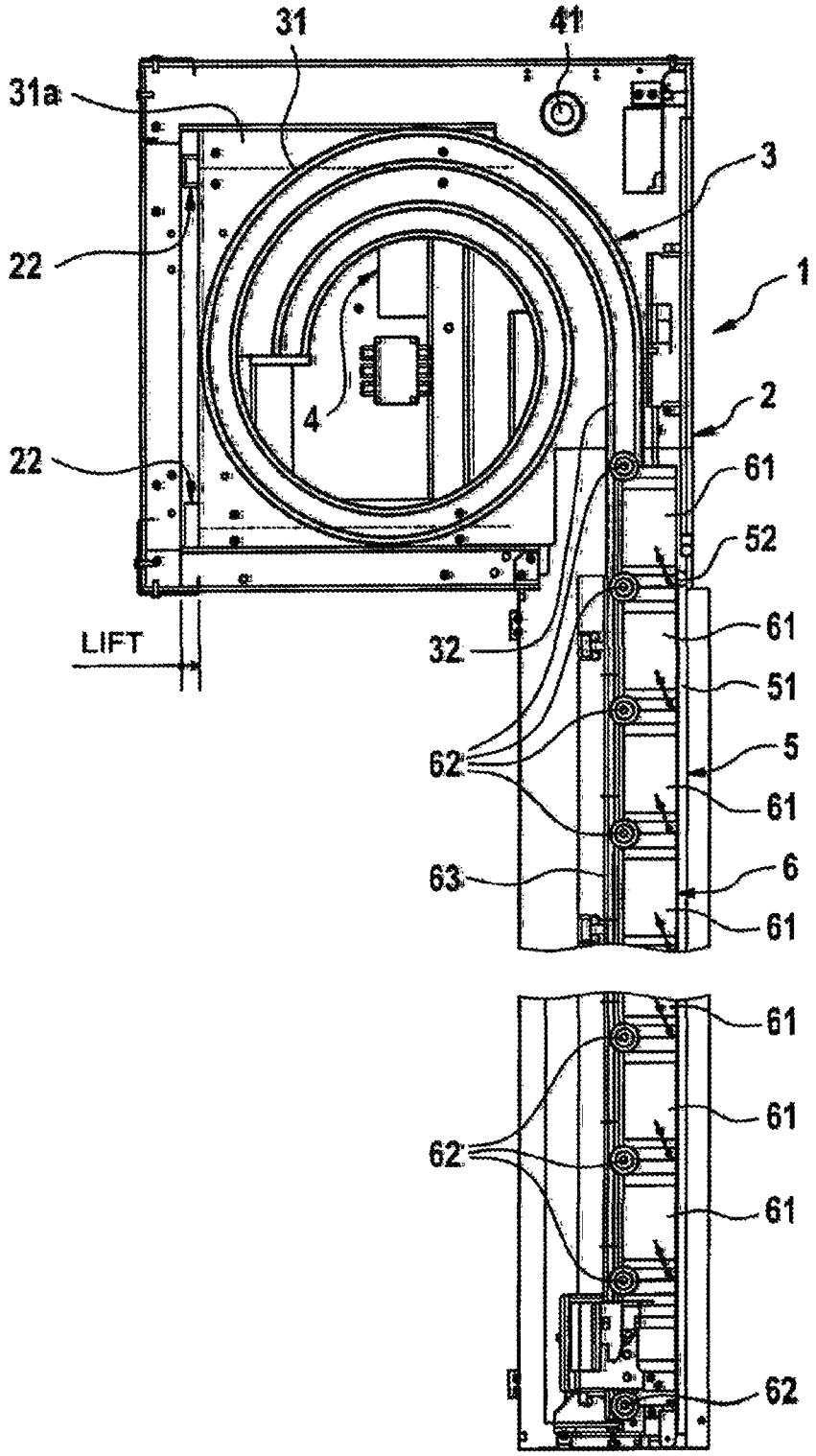
FIG. 2 a view that has been modified relative to FIG. 1 such that the guide has been displaced in a direction to the outer side of the door, wherein the door leaf is also illustrated here.

FIG. 2, however, illustrates the situation in which the guide 3 has been displaced at the frame 2. The guide 3 is here displaceably mounted on the frame in a manner that will be explained in detail later.

FIG. 2 further also illustrates a door leaf 6 of the lifting door 1 which is, in the position according to FIG. 2, completely accommodated in the vertical section 32 of the guide 3. The door leaf 6 is mounted in the guide 3 and is thus displaced horizontally together with the vertical section 32 and/or the guide 3 when the lifting door 1 moves on to the position according to FIG. 2. The displacing movement takes place diagonally to the door leaf plane that is defined by the large faces—inner face and/or outer face—of the door leaf in the closed condition.

Thus, the door leaf 6 presses against the sealing assembly 5 that is, in the present embodiment, designed as a tube seal. The sealing assembly 5 comprises frame sealing elements 51 that are attached to the corresponding frame 2 at each side of the door opening across the door height, and a lintel sealing element 52 that is attached to the door lintel. The two vertical frame sealing elements 51 and the horizontally extending lintel sealing element 52 are connected with each other by gluing, so that the sealing assembly 5 is available as an integral element. Thus, even in the corner region at the joints of the sealing elements 51 and/or 52 there results no gap, and hence a reliable sealing effect. In the non-displaced position of the guide 3 and/or the door leaf 6 according to FIG. 1 the door leaf 6 is, however, spaced apart from the sealing assembly 5. By the pressure of the door leaf 6 on the sealing assembly 5 in the position according to FIG. 2 a reliable sealing is achieved in this region.

As is further revealed by FIG. 2, the door leaf 6 comprises a plurality of slats 61 each extending diagonally over the door opening from one frame 2 to the other frame that is not illustrated here, and are connected to one another so as to bend. The slats 61 are each mounted in the lateral guides 3 via guide rollers 62. Furthermore, the slats 61 are coupled with each other through strap hinges 63 available on both sides adjacent to the frames 2, via which the drive force for the operation of the door leaf 6 is transferred to same. The construction of the door leaf 6 and its cooperation with the guides 3 is of conventional nature as such and is, for instance, known from DE 199 15 376 A1.

Figure 3:
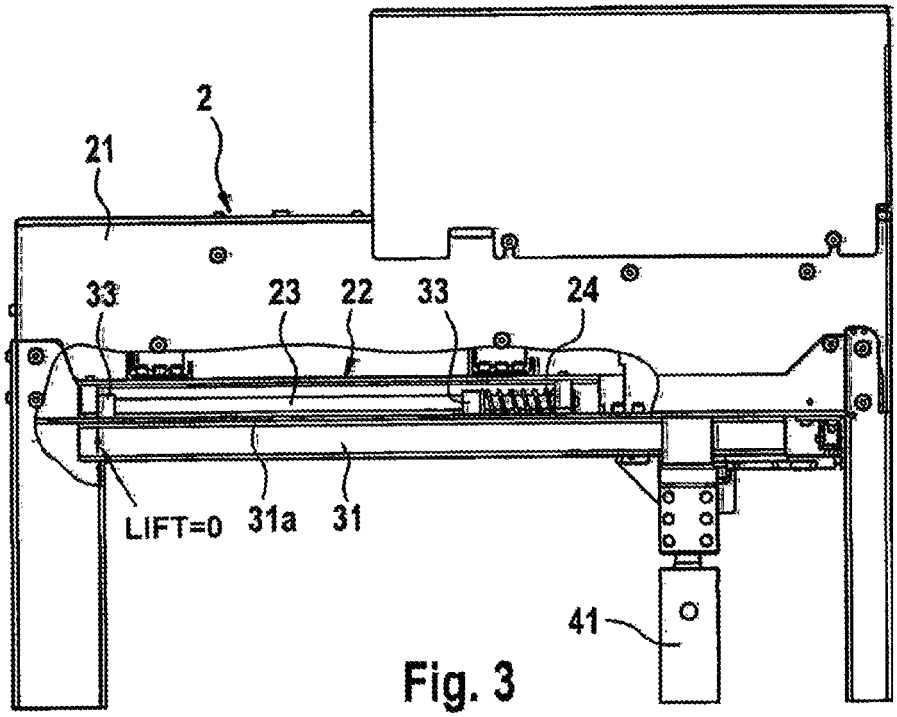
FIG. 3 a top view of the lintel section of the guide with non-displaced guide.
Figure 4:
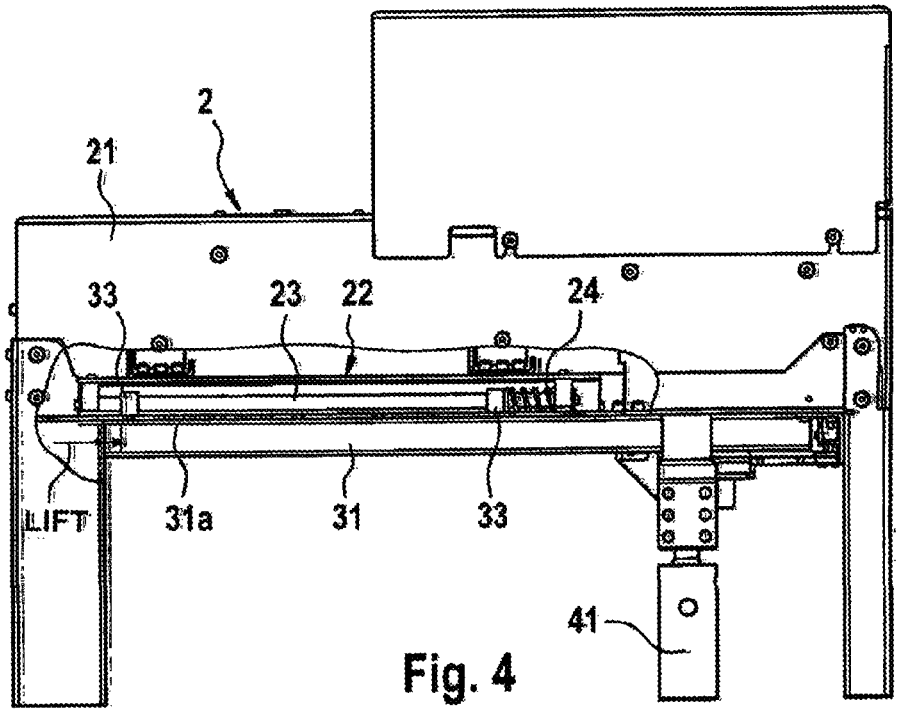
FIG. 4 an illustration similar to FIG. 3, wherein the guide has been displaced with respect to the position in FIG. 3.

FIGS. 3 and 4 show a top view of the lintel region of the guide 3 in more detail. In the illustration according to FIG. 3, the guide 3 is in its basic position, which means it has not been displaced relative to the lintel 2 in a direction to the outer side of the door. FIG. 4, in contrast, illustrates the situation with a displaced guide 3 in which the door leaf 6 that is not illustrated here is completely available in the vertical section 32. The degree of displacement is marked by the word "LIFT" in FIGS. 3 and 4. In FIG. 3 LIFT=0 since no displacement exists, whereas FIG. 4 indicates a displacement by a predetermined degree.

In FIGS. 3 and 4 a linear guide 22 is further illustrated in more detail. As results from FIG. 2, two such linear guides 22 are provided in the region of the lintel section 31 of the guide 3 so as to mount it to be moved diagonally to the door leaf plane, i.e. horizontally, by means of the carrier element 31*a*. The linear guide 22 comprises a bearing shaft 23 mounted to be moved in bearing bushings 33. Furthermore, a return spring 24 in the form of a compression spring is fitted on the bearing shaft 23 which counteracts the displacement of the lintel section 31 of the guide 3 in a direction to the outer side of the door and thus causes a return of the lintel section 31 to its initial position when the actuating mechanism is released.

In this process, the guides 3 are displaced at both sides of the door opening as a whole and to the same extent at the respectively associated frame 2. The displacing movement thus relates both to the lintel section 21 and to the vertical section 32 of a guide 3, as will be explained further in the following by means of FIGS. 5 and 6.

Figure 6:
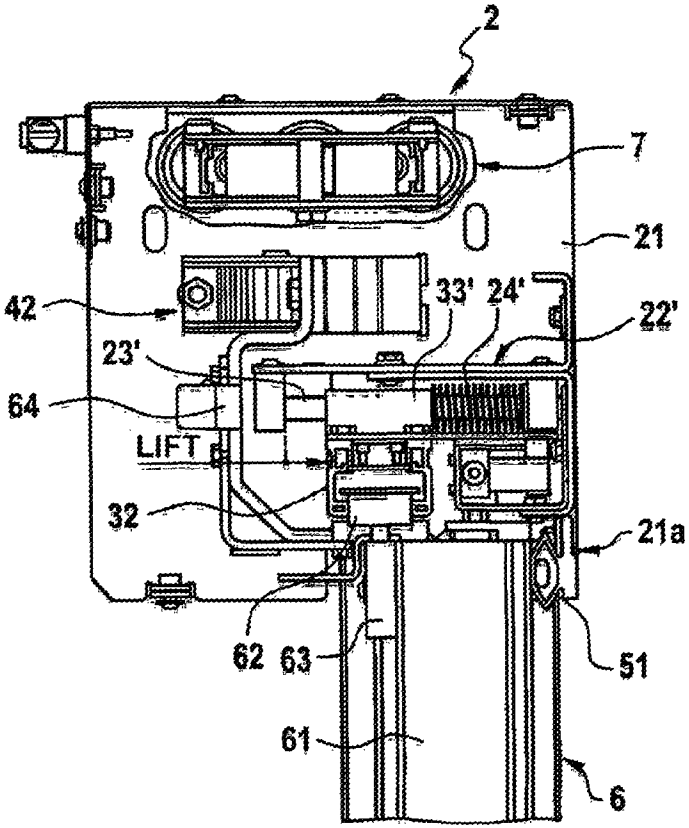
FIG. 6 an illustration similar to FIG. 5, wherein, however, the guide, together with the door leaf, has been displaced in the direction to the outer side of the door.
Figure 5:
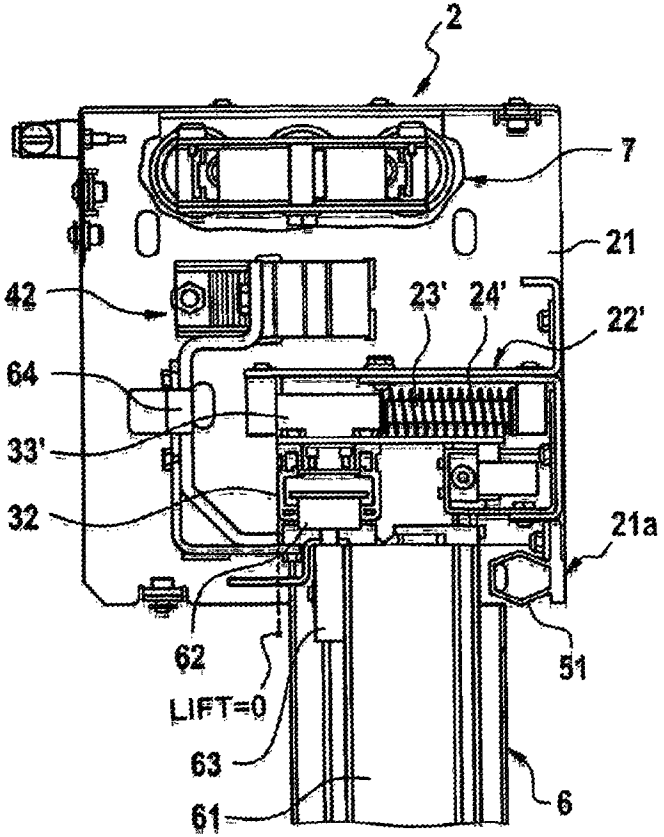
FIG. 5 a top view of the vertical section of the guide of the lifting door according to the invention with non-displaced guide.

FIGS. 5 and 6 show top views of a frame 2 with an adjacent door leaf 6 in the region of a vertical section 32. FIG. 5 again illustrates the condition with LIFT=0, i.e. non-displaced vertical section 32, whereas FIG. 6 represents the displaced position of the vertical section 32 by a predetermined degree for LIFT. As can be clearly seen from these two illustrations, a movement gap exists between the sealing assembly 5 and the door leaf 6 with a non-displaced vertical section 32, so that the sealing assembly 5 is not subject to a dragging strain when the door leaf 6 is moved. In accordance with the illustration in FIG. 6, however, the door leaf 6 presses against the sealing assembly 5 in the displaced position of the vertical section 32 and provides a reliable sealing in the region of the side edges (and in the lintel region) of the door opening.

FIGS. 5 and 6 moreover illustrate further elements of the lifting door 1. Thus, a frame housing 21 of the frame 2 is illustrated. Furthermore, a section 21*a* of the frame 2 which faces the door opening is designated in detail, on which a frame sealing element 51 of the sealing assembly 5 is fixed. Moreover, a weight balancing means 7, the spring assembly of which is in particular recognizable in these Figures in top view, is additionally arranged in the frame 2.

Moreover, the frame 2 includes a belt drive 42 of the drive unit 4 by means of which the driving force of the motor is transferred to the door leaf 6 via the drive shaft 41. The belt drive 42 cooperates with a door leaf accommodation 64 at the door leaf 6 which engages at the lower end of the door leaf 6 in the region of the end element thereof or of an adjacent slat 61.

Moreover, FIGS. 5 and 6 illustrate a linear guide 22' for the vertical section 32 of the guide 3. This linear guide 22' differs from that in the door lintel region only in its concrete constructional shape, the mode of operation is, however, identical. The vertical section 32 is mounted to be moved by means of a bearing bushing 33' on a bearing shaft 23' of the linear guide 22'. Furthermore, a return spring 24' in the form of a compression spring is fitted on the bearing shaft 23' which counteracts a displacement of the vertical section 32 in a direction to the outer side of the door and thus causes a return of the vertical section 32 together with the lintel section 31 when the actuating mechanism is released. FIGS. 5 and 6 also reveal the displacement of the vertical section 32 in the region of the linear guide 22'.

Such a linear guide 22' is arranged in at least two positions at the frame 2 across the door height. Corresponding linear guides 22' are also available in mirror image in the opposite frame. In order to avoid canting of the guide 3 in the course of the displacement and in particular in the case of larger door heights, more than two linear guides 22' per door side are also provided.

Figure 8:
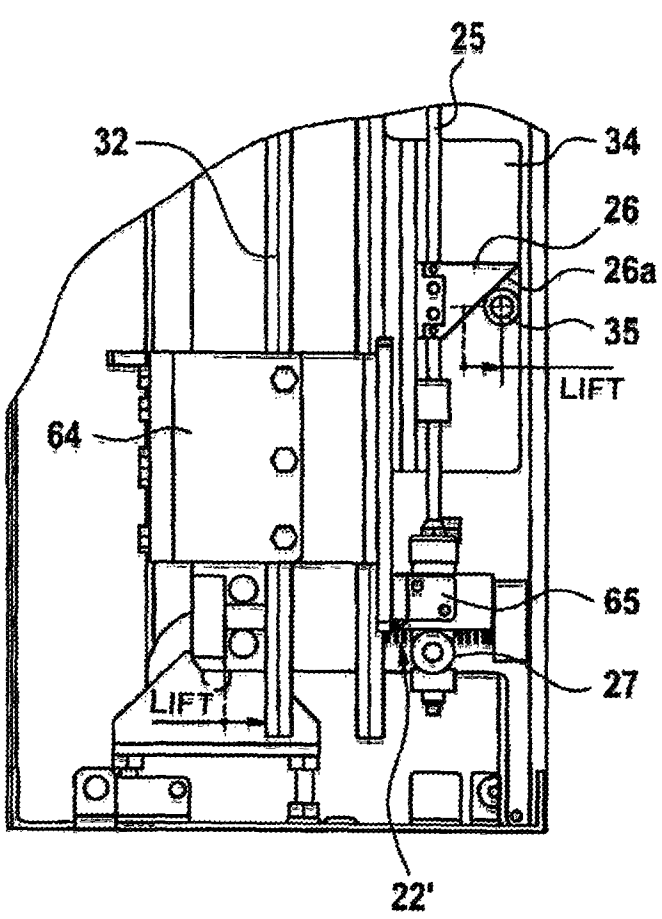
FIG. 8 an illustration similar to FIG. 7, wherein the guide has been displaced to the outer side of the door.
Figure 7:
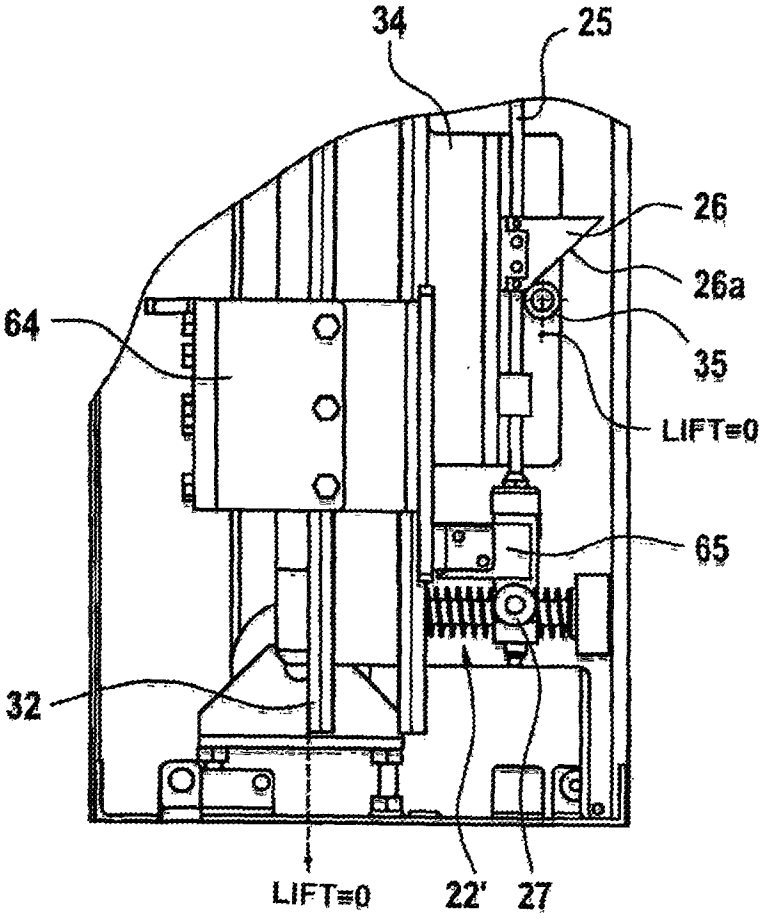
FIG. 7 a detail of a side view of the lifting door according to the invention in the region of its contact area with non-displaced guide.

FIGS. 7 and 8 illustrate closer details of the actuating mechanism by which the displacement of the guide 3 in each frame is enabled. In the present embodiment this displacement is initiated and/or controlled by the movement of the door leaf 6. For this purpose, an actuating rod 25 extending vertically across the door height and being mounted at the upper and lower ends of the door opening at the frame is positioned in the region of each lateral frame 2. A plurality of actuating blocks 26 having an oblique guiding face 26*a* are attached to this actuating rod 25. The actuating blocks 26 cooperate with a deflection roller carrier 34 that is attached to the vertical section 32 and carries a deflection roller 35. The deflection roller 35 rolls off at the oblique guiding face 26*a* of an actuating block 26 on establishing the displacement and/or on resetting the displacement of the guide 3.

The displacing movement is initiated by the door leaf accommodation 64 comprising a pressure section 65. The latter presses, in the course of the closing process of the door leaf, on a roller 27 mounted at the lower end of the actuating rod 25 shortly before the final closure position is reached. The actuating rod 25 is mounted in the frame 2 to be moved in its longitudinal direction, so that it is pressed downward to the contact face by the effect of the pressure section 65. This initiates a roll-off movement of the deflection roller 35 along the oblique guiding face 26*a*. Thus, the door leaf 6 is, in the last movement section, not just moved downward, but simultaneously also in a direction to the outer side of the door.

Figure 9:
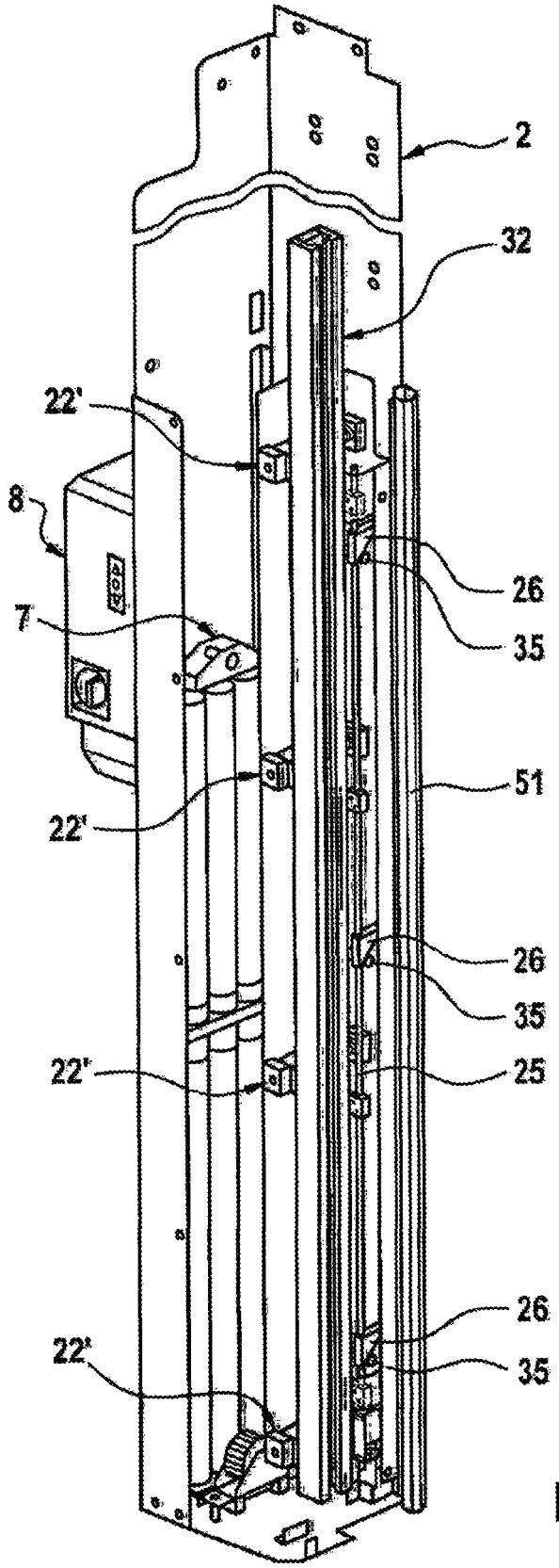
FIG. 9 a schematic perspective view of a frame region at the lifting door according to the invention.

FIG. 9 illustrates a schematic perspective view of a frame 2. It also reveals a control unit 8 for controlling the operation of the lifting door 1. In particular, however, FIG. 9 illustrates four linear guides 22' for a vertical section 32. This avoids canting of the vertical section 32. Moreover, FIG. 9 also reveals three actuating mechanisms with a corresponding number of actuating blocks 26 and deflection rollers 35. The displacement force introduced by the actuating rod 25 is hence transferred to the vertical section 32 of the guide 3 in three positions.

Figure 10:
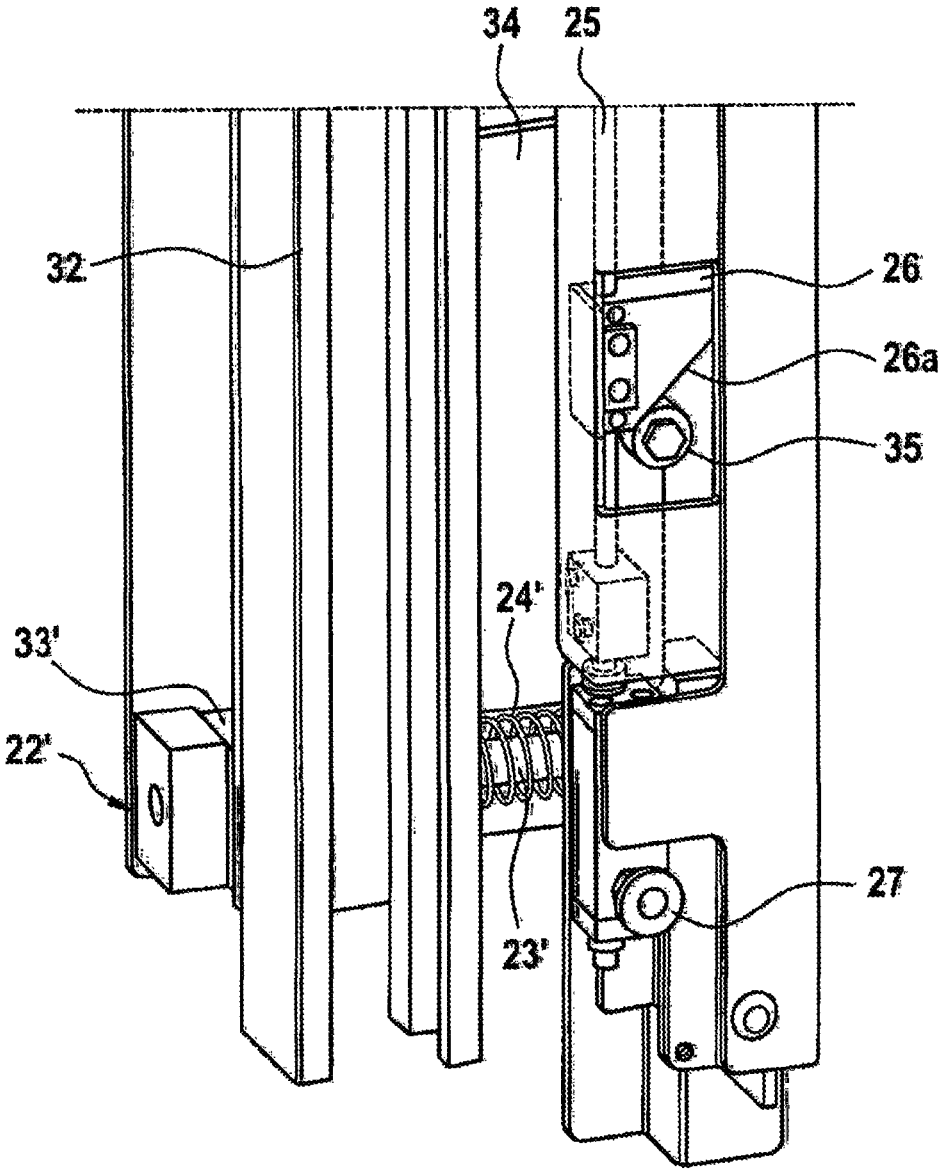
FIG. 10 a detail view of the mounting of the vertical section of the guide at the frame.

FIG. 10 illustrates an actuating mechanism in closer detail, wherein in particular the actuating rod 25, its mounting, as well as the roller 27 are also clearly recognizable. The non-illustrated pressure section 65 acts on the roller 27 at the door leaf accommodation 64 and presses it downward, so that the actuating rod 25 is pulled downward as a whole.

FIG. 10 also illustrates a linear guide 22' in closer detail. As is revealed, the vertical section 32 is firmly connected with the bearing bushing 33' that is adapted to be slidingly moved on the bearing shaft 23'. The return spring 24' causes the return of the vertical section 32 as soon as the pressure on the roller 27 has been released and the actuating rod 25 that is also spring-biased in counter direction has returned to its rest position. The actuating blocks 26 are, together with the actuating rod 25, displaced upward such that the deflection rollers 35 roll off at the oblique guiding face 26 in counter direction and the vertical section 32 can return to its initial position.

Figure 12:
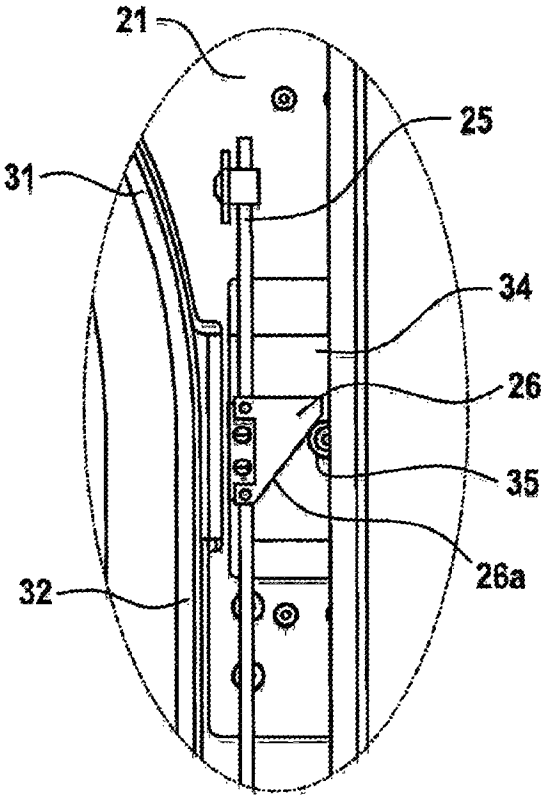
FIG. 12 an illustration similar to FIG. 11, wherein the guide has been displaced here.
Figure 11:
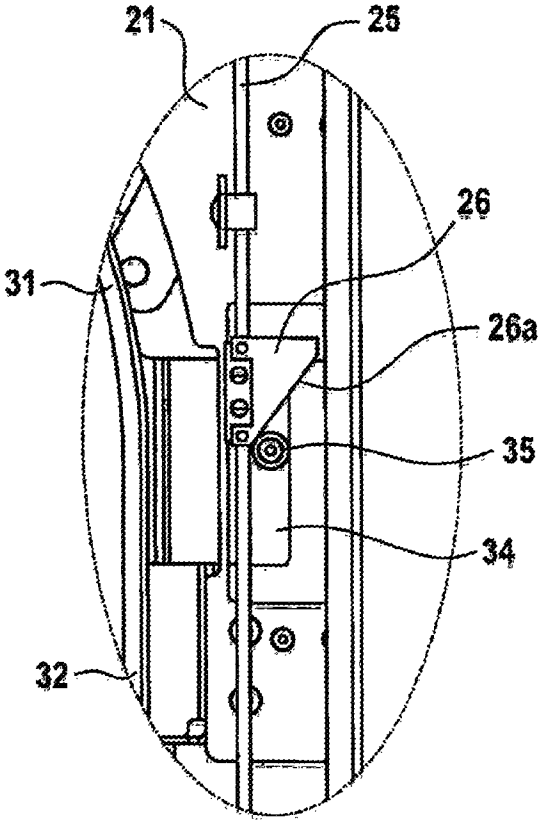
FIG. 11 an enlarged detail view of a frame in the transition area from the vertical section to the lintel section with non-displaced guide.

FIGS. 11 and 12 show detail views of the actuating mechanism in the region of the transition from the vertical section 32 to the lintel section 31. FIG. 11 illustrates again the initial condition in which the guide 3 is not displaced to the outer side. FIG. 12, in contrast, illustrates the displaced condition of the guide 3 in which it presses against the sealing assembly 5. As is revealed by FIGS. 11 and 12, the actuating mechanism is in this region designed identical to the actuating mechanisms in the region of the vertical section 32. Here, too, an actuating block 26 is attached to the actuating rod 25 and cooperates with a deflection roller 35 resting on a deflection roller carrier 34. The deflection roller 35 rolls off at the oblique guiding face 26*a* of the actuating block 26 on establishing the displacement and/or on resetting the displacement of the guide 3.

This way, the lintel section 31 is, via the carrier element 31*a*, together with the vertical section 32 displaced without interruption diagonally to the door leaf plane by the influence of the actuating rod 25.

Figure 13:
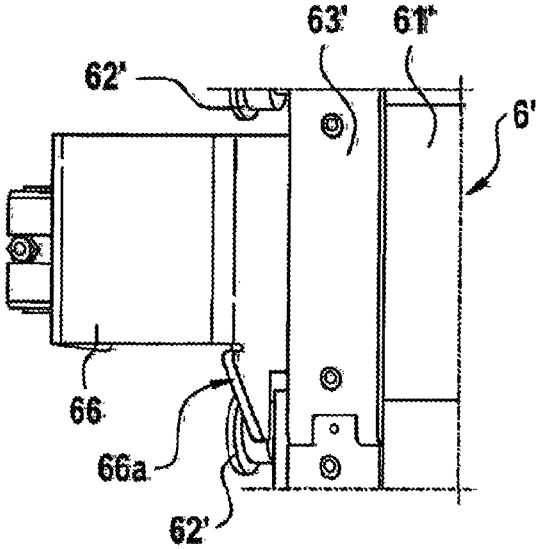
FIG. 13 a schematic perspective illustration of a lower actuator accommodation for an actuating mechanism in accordance with a second embodiment.
Figure 14:
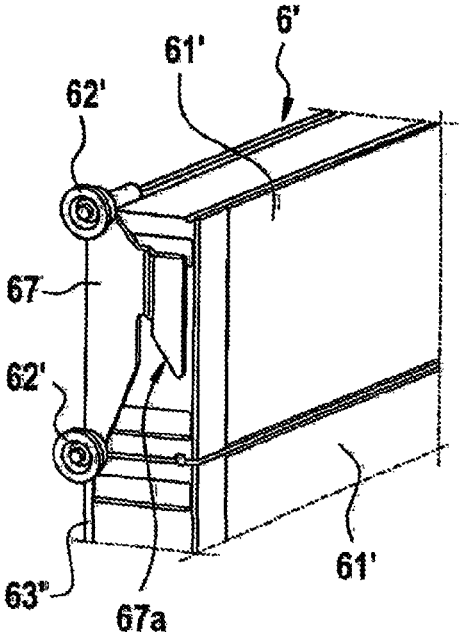
FIG. 14 a schematic perspective view of an upper actuator accommodation for an actuating mechanism in accordance with the second embodiment.
Figure 15:
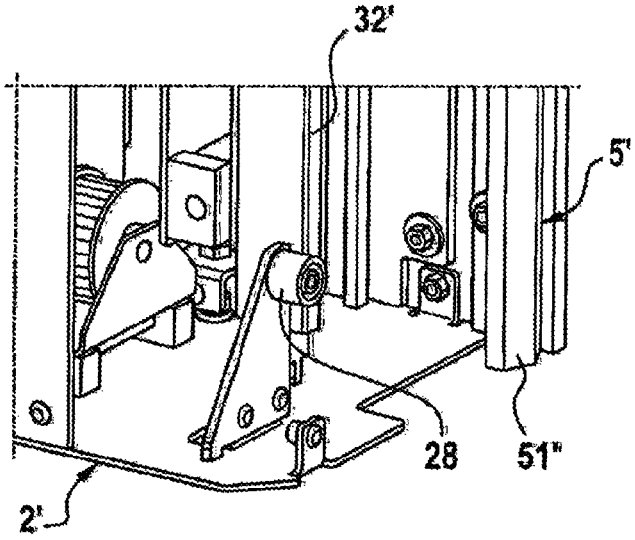
FIG. 15 a schematic perspective view of a lower guide roller for the actuating mechanism according to the second embodiment.
Figure 16:
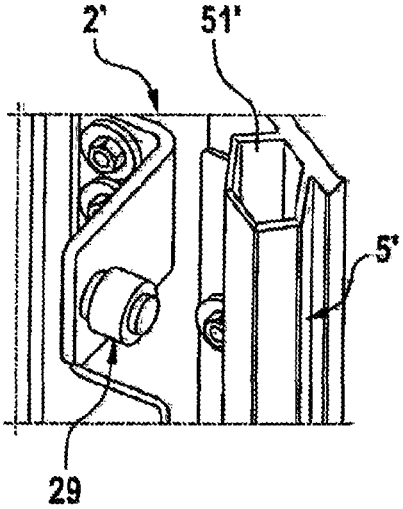
FIG. 16 a schematic perspective view of an upper guide roller for the actuating mechanism according to the second embodiment.

FIGS. 13 to 16 illustrate an alternative embodiment for an actuating mechanism. In this embodiment an actuating rod is renounced and the force for a displacement of the guide is introduced at the upper and lower ends of a door leaf 6'. For this purpose, actuating accommodations are arranged at these positions, wherein FIG. 13 shows a lower actuating accommodation 66 and FIG. 14 an upper actuating accommodation 67. They each comprise oblique guide faces 66*a* and 67*a* which cooperate with guide rollers that are fixed immovably to a frame 2'. FIG. 15 illustrates a lower guide roller 28 and FIG. 16 illustrates an upper guide roller 29.

In the course of the closing process of the door leaf 6' the oblique guiding face 66*a* of the lower actuating accommodation 66 gets into engagement with the lower guide roller 28 which then rolls off thereon. Substantially at the same time the oblique guide face 67*a* of the upper actuating accommodation 67 gets into engagement with the upper guide roller 29 which also rolls off thereon. Thus, a displacement of the door leaf 6' relative to the frame 2' results, so that the door leaf 6' is, together with a vertical section 32', moved in a direction to the outer side of the door. The vertical section 32' and hence the entire guide 3 is thus displaced horizontally indirectly by the door leaf 6' in this second embodiment in that it is taken along by the guide rollers 62' mounted at the slats 61' and/or strap hinges 63'. By this, too, a frame sealing element 51' of the sealing assembly 5' which is illustrated in FIGS. 15 and 16 is compressed when the lifting door is closed, so that a reliable sealing is achieved in this region.

Moreover, the guide is here mounted at the frame 2' in a per se identical manner by means of linear guides such as the linear guides 22 and/or 22' of the first embodiment, so that canting of the door leaf 6' and/or of the guide is avoided.

In addition to the embodiments explained, the invention allows further design approaches.

Thus, it is also possible to use other kinds of actuating mechanisms than the actuating rod, etc. for initiating the displacement of the guide 3 as long as a reliable operation of the lifting door 1 is possible. Examples thereof are traction elements such as toothed belts, chains, ropes, etc.

Moreover, it is, however, also possible to use separate drive means instead of the actuating mechanisms explained and to establish the displacement of the lintel and vertical sections of the guides at the frames independently of the kinetic energy of the door leaf. These drive means might, for instance, be servomotors or motor-driven separate control elements of some other kind by means of which a displacing movement on the lintel and vertical sections and/or the door leaf is initiated at a predetermined number of greater than two positions across the door height. These separate drive means might additionally be operated by the same control unit as the lifting door 1 as such or else by a separate control unit arranged in addition thereto and preferably connected therewith with respect to control. Such control unit may be triggered by a trigger device responding to a particular door leaf movement by electrical, electronic, optical means, etc.

Furthermore, the angle of inclination of the oblique guiding face 26*a* of the actuating blocks 26 may be chosen differently depending on the application. An angle of inclination of between 20 and 45 degrees relative to the vertical is preferred. By the choice of angle it is possible to influence the relation between the vertical and the horizontal door leaf lift in the course of the movement. In the case of an angle of 45 degrees the relation is, for instance, 1:1.

The lifting door according to the invention may additionally also be implemented without the lintel sealing element 52, so that the sealing assembly 5 or 5', respectively, then merely comprises the two lateral frame sealing elements 51 or 51', respectively. In this case a door lintel sealing assembly according to DE 10 2008 007 592 A1 may be provided alternatively. Thus, a reliable sealing effect is not just achieved in the region of the lateral frames, but also in the door lintel region.

In the illustrated embodiment, the lintel section 31 of the guide 3 is designed as a round spiral. Instead, an elongate spiral shape as it has, for instance, become known from DE 40 15 214 A1 may, however, also be chosen.

In a modified embodiment it is further also possible that the lintel section 31 is designed integrally with the carrier element 31 a.

Furthermore, in the embodiments illustrated the force introduction of the drive on the door leaf takes place at the lower end of the door leaf. This is not stringently necessary, though. In the case of a construction according to WO 2007/045423 A1, for instance, it is, also in the scope of the present invention, absolutely possible to have the door leaf drive act on the upper end of the door leaf, so that the drive force is introduced there.

The invention claimed is:

1. A lifting door comprising:

a movable door leaf, the door leaf comprising a plurality of slats connected to one another so as to bend, the door leaf arranged to cover a door opening in a closed condition;

a drive unit configured to move the door leaf;

structure-mounted frames arranged on both sides of the door opening;

a plurality of lateral guides arranged at the frames, each of the plurality of lateral guides comprising a vertical section and a lintel section;

a sealing assembly with frame sealing elements arranged at the frames, wherein the frame sealing elements close a gap between the door leaf and a section of the frames facing the door opening when the lifting door is closed, wherein the door leaf is pressed against the sealing assembly when the lifting door is closed;

a trigger device comprising an actuating rod and a plurality of actuating blocks having guide surfaces;

a frame-side actuator comprising a plurality of deflection rollers in a vertical spaced apart relation;

wherein the door leaf is guided in the lateral guides such that it is disposed in the lintel sections when the lifting door is open and in the vertical sections of the lateral guides when the lifting door is closed;

wherein the lintel sections and the vertical sections of the lateral guides are displaceably mounted on the frames, so that the door leaf is displaceable in a direction to an outer side of the lifting door when the lifting door is in the closed condition;

wherein the trigger device is configured to cause the guide surfaces to engage the plurality of deflection rollers concurrently to effect displacement of the vertical sections at the frames;

wherein the lintel sections of the guides form a spiral configuration having spaced-apart lateral guide regions, wherein the door leaf, in an open condition of the lifting door, is disposed within the spaced-apart lateral guide regions; and wherein the guides can only be displaced in a linear horizontal direction, but not in a moving direction of the door leaf.

2. The lifting door according to claim 1, wherein the lintel sections of the guides are disposed on a carrier element mounted on the frames.

3. The lifting door according to claim 1, wherein the trigger device engages the frame-side actuator to initiate displacement of the guides via the deflection rollers.

4. The lifting door according to claim 1, wherein the trigger device comprises actuating accommodations attached at upper and lower ends of the door leaf, into which frame-side mounted guide rollers engage to effect displacement of the guides at the frames.

5. The lifting door according to claim 1, wherein the trigger device comprises a control unit and a separate drive means configured to effect displacement of the guides when the door leaf is in the closed condition, wherein the separate drive means comprises at least two control elements establishing the displacement of the guides at the frames.

6. The lifting door according to claim 1 wherein the sealing assembly further comprises a lintel sealing element connected with a vertical frame sealing element.

7. A method for closing a gap at a lifting door, which gap exists between a door leaf and a section of frames facing the door opening, at which frame sealing elements of a sealing assembly are arranged, wherein lateral guides for the door leaf facing each other are arranged at the frames which comprise a vertical section and a lintel section, wherein the door leaf is designed of slats connected to one another so as to bend and covers the door opening in the closed condition, wherein the door leaf is guided in the lateral guides such that it is accommodated in the lintel sections when the lifting door is open and in the vertical sections of the guides when the lifting door is closed, wherein the guides are displaceably mounted on the frames, and wherein the lintel sections of the guides are designed to be spiral, the method comprising the steps of:

moving the door leaf into its closed position, and in response to moving the door leaf into its closed position, engaging a plurality of actuating blocks having guide surfaces with a plurality of deflection rollers disposed in a vertical spaced apart relation on a frame-side actuator concurrently;

in response to engaging the plurality of actuating blocks with the plurality of deflection rollers concurrently, linearly displacing the lintel sections of the guides together with the vertical sections of the guides horizontally to the door leaf plane in a direction to the outer side of the door without a movement of the guides in a moving direction of the door leaf, so that the door leaf is pressed against the sealing assembly.

8. A lifting door comprising:

a plurality of frames disposed proximal a door opening, each of the plurality of frames comprising a seal;

a door leaf;

a drive unit operatively connected to the door leaf and which moves the door leaf between an open and a closed position;

a plurality of door leaf guides, each of the plurality of door leaf guides comprising a vertical section and a lintel section, the vertical section and the lintel section being displaceable in a linear horizontal direction but not in a moving direction of the door leaf, the lintel section forming a spiral configuration having spaced-apart lateral guide regions;

an actuating mechanism movable in a longitudinal direction, the actuating mechanism including an actuating rod and a plurality of actuating blocks having guide surfaces;

a plurality of vertically spaced deflection rollers;

wherein the guide surfaces of the plurality of actuating blocks engage the plurality of vertically spaced deflection rollers concurrently when the actuating mechanism is moved in the longitudinal direction such that the vertical section, the lintel section, and the door leaf are displaced in a linear horizontal direction and restricted in a vertical direction.

* * * * *